United States Patent [19]

Goffinet et al.

[11] Patent Number: 4,470,919

[45] Date of Patent: Sep. 11, 1984

[54] OXYGEN-BLEACH-CONTAINING LIQUID DETERGENT COMPOSITIONS

[75] Inventors: Pierre Goffinet, Marseilles, France; Ivan Herbots, Ghent, Belgium; Santiago Tapia, Madrid, Spain

[73] Assignee: The Procter & Gamble Company, Cincinnati, Ohio

[21] Appl. No.: 460,697

[22] Filed: Jan. 24, 1983

[30] Foreign Application Priority Data

Feb. 3, 1982 [GB] United Kingdom ..... 8203142

[51] Int. Cl.[3] ..... C11D 7/18; C11D 7/54

[52] U.S. Cl. ..... 252/102; 252/95; 252/96; 252/98; 252/104; 252/174.12; 252/186.29; 252/186.43; 252/DIG. 14

[58] Field of Search ..... 8/107, 111; 252/94, 252/95, 96, 98, 102, 174.12, 186.29, 186.43, DIG. 14

[56] References Cited

U.S. PATENT DOCUMENTS

| | | | |
|---|---|---|---|
| 2,917,428 | 12/1959 | Hitzman | 252/186.29 X |
| 3,194,768 | 7/1965 | Lindner et al. | 252/102 X |
| 3,388,069 | 6/1968 | Lindner et al. | 252/99 |
| 3,766,078 | 10/1973 | Kowalski | 252/186 |
| 3,860,391 | 1/1975 | Kling et al. | 8/111 |
| 3,970,575 | 7/1976 | Barrett | 252/95 |
| 4,051,058 | 9/1977 | Böwing et al. | 252/186 |
| 4,059,678 | 11/1977 | Winkley | 423/273 |
| 4,079,015 | 3/1978 | Paucot et al. | 252/95 |
| 4,119,486 | 10/1978 | Eckert | 162/65 |
| 4,238,192 | 12/1980 | Kandathil | 8/111 |
| 4,298,492 | 11/1981 | van den Brom | 252/97 |
| 4,347,149 | 8/1983 | Smith et al. | 252/102 |

FOREIGN PATENT DOCUMENTS

| | | |
|---|---|---|
| 37184 | 9/1981 | European Pat. Off. . |
| 2532866 | 1/1977 | Fed. Rep. of Germany . |

OTHER PUBLICATIONS

Abstract–Japanese Patent J4 9015–698, published 2/12/74.

Abstract–German Patent 2,532,866, published 1/1/77.

Abstract–Japanese Patent J5 1037–086, published 3/29/76.

*Primary Examiner*—Prince E. Willis

*Attorney, Agent, or Firm*—Donald E. Hasse; Robert B. Aylor; Thomas H. O'Flaherty

[57] ABSTRACT

Oxygen-bleach-containing liquid detergent compositions capable of providing remarkable cleaning and bleaching performance over a prolonged period of time are disclosed. The oxygen-bleach component is usually represented by hydrogen peroxide or equivalent addition products. The oxygen-bleach is stabilized with the aid of a binary system, namely: fatty acids and water soluble calcium salts, with the further understanding that the compositions are substantially free of conventional detergent polyphosphate. These bleach-containing liquid detergents are especially useful in boil-wash laundry treatments.

10 Claims, No Drawings

OXYGEN-BLEACH-CONTAINING LIQUID DETERGENT COMPOSITIONS

This invention relates to liquid detergent compositions containing an oxygen-bleach compound. The oxygen-bleach ingredient is usually represented by hydrogen peroxyde or its corresponding addition products such as water-soluble percarbonates, perborates, percarbamide and more in general all oxygen-bleach compounds that have found application in detergent technology. The oxygen-bleach-compound is stabilized with the aid of a binary system comprising a major amount of fatty acids and a specific minimum level of water-soluble calcium salts, with the further proviso that the compositions are substantially free of detergent polyphosphates. The compositions of this invention are capable of providing remarkable performance benefits upon use in laundry operation in lieu of conventional detergent formulae. The inventive compositions are particularly suitable for use in boilwash laundry treatment.

DESCRIPTION OF THE ART

The formulation of commercially viable, stable liquid detergent compositions containing substantial levels of oxidizing bleaches is known to represent an unusual challenge because of insufficient stability of oxidizing bleaches in aqueous compositions, their high reactivity towards organic materials which are normally used in such compositions, and also because of the extreme sensitivity of such bleaches in presence of traces of metal ions, such as copper and iron, which can result in a substantial decomposition within a relatively short time.

Whilst numerous attempts have been undertaken to formulate stable liquid detergent compositions allowing the simultaneous use of oxidizing bleaches, more particularly hydrogen peroxide, and a builder, success has not attended these efforts and no commercially-viable technology was generated as of yet. Although the prior art is possessed of means to provide a certain degree of oxygen stabilization, this art technology is sub-standard with a view of formulate commercial products having a reasonable shelf life time at trade conditions with no visible effect of hydrogen peroxide decomposition (such as package swelling, foam formation, etc . . . ) and with an unaltered performance profile over prolonged periods of storage.

Japanese patents J5-10.37.068 and J4-90.15.698 disclose the use of magnesium soap suspensions as stabilizer of hydrogen peroxide in cotton yarn bleaching baths. Similarly, it is known from German patent 25.32.866 that textile bleaching baths containing hydrogen peroxide can be stabilized by fatty acid soaps, inclusive of calcium or magnesium soaps, and/or fatty esters. Combinations of earthalkali metal salts, inclusive of calcium water-soluble salts, and 1-hydroxy-ethylene-1.1-diphosphonic acid and/or nitrilotriacetic acid or their salts, are known from German patent 22.26.784. The combinations allegedly provide enhanced stability properties to alkaline aqueous peroxyde solutions. Belgian Patent 883.947 pertains to liquid detergent compositions comprising major amounts of surfactants, sodium tripolyphosphate, potassium pyrophosphate, a low level of soap, and optionally hydrogen peroxide. European Patent 0.037.184 also describes built liquid detergent compositions containing hydrogen peroxide in combination with anionic and/or nonionic surfactants, alkali metal polyphosphonate, and hydroxypolycarboxylic or aminopolycarboxylic complexing builders. Belgian patent 795.085 relates to the use of hydrogen peroxide in fiber-bleaching baths which are substantially free of silicates. German patent application DOS 26.04.990 discloses liquid cleaning compositions containing oxygen bleach, possibly peroxide, and salts of polymers which are derived from $\alpha$-hydroxyacrylic acid.

It is an object that this invention to formulate liquid detergent compositions containing major amounts of an oxygen-bleach component.

It is a further object of this invention to provide effective oxygen-containing liquid detergent compositions having a good storage stability over prolonged periods of storage and a substantially unchanged performance profile upon use in lieu of conventional liquid detergents.

The above and other benefits can now be achieved with the liquid compositions of this invention.

SUMMARY OF THE INVENTION

The oxygen-bleach-containing liquid detergent compositions of this invention comprise:

(a) from 10% to 60% by weight of an anionic, nonionic, or zwitterionic surface-active agent or mixtures thereof;

(b) from 1% to 20% by weight of hydrogen peroxide;

(c) from 5% to 30% by weight of a fatty acid having from 8 to 24 carbon atoms, whereby the weight ratio of (a) to (c) is equal to or greater than 1; and (d) a water-soluble calcium salt to provide at least $5.10^{-3}$ mole calcium per liter of the liquid detergent, said detergent composition being substantially free of polyphosphates; and having a pH, as is at 20° C., below 9.

In a preferred aspect, the compositions herein comprise from 15% to 40% by weight of a combination of surface-active agents, namely anionic and nonionic surfactants. Preferred anionic surfactant species include: alkyl benzene sulfonates; alkyl sulfates; and alkyl ether sulfates. The compositions herein can also comprise, as a preferred optional ingredient, from 0.5% to 5% by weight of quaternary ammonium compounds such as a $C_{12-18}$ alkyltrimethyl ammonium chloride.

The hydrogen peroxyde level can be varied in accordance with the contemplated utilization of the composition, although in some heavy duty liquid detergents, hydrogen peroxide is preferably used in ranges from 5% to 8% by weight.

The fatty acid component is preferably used in levels from 8% to 16% by weight.

DETAILED DESCRIPTION OF THE INVENTION

The oxygen-bleach containing liquid detergent compositions of this invention contain a series of essential components, are substantially free of poly-phosphate detergent builders, and are further characterized by a pH below 9. Each of the individual formulation parameters are described in more detail hereinafter.

Unless indicated to the contrary, the "%" indications stand for "% by weight".

The liquid detergent compositions herein contain from 10% to 60%, preferably from 15% to 40% of an organic surface-active agent selected from nonionic, anionic, and zwitterionic surface-active agents and mixtures thereof.

Synthetic anionic surfactants can be represented by the general formula $R^1SO^3M$ wherein $R^1$ represents a hydrocarbon group selected from the group consisting of straight or branched alkyl radicals containing from about 8 to about 24 carbon atoms and alkyl phenyl radicals containing from about 9 to about 15 carbon atoms in the alkyl group. M is a salt forming cation which typically is selected from the group consisting of sodium, potassium, ammonium, and mixtures thereof.

A preferred synthetic anionic surfactant is a water-soluble salt of an alkylbenzene sulfonic acid containing from 9 to 15 carbon atoms in the alkyl group. Another preferred synthetic anionic surfactant is a water-soluble salt of an alkyl sulfate or an alkyl polyethoxylate ether sulfate wherein the alkyl group contains from about 8 to about 24, preferably from about 10 to about 18 carbon atoms and there are from about 1 to about 20, preferably from about 1 to about 12 ethoxy groups. Other suitable anionic surfactants are disclosed in U.S. Pat. No. 4,170,565, Flesher et al., issued Oct. 9, 1979, incorporated herein by reference.

The nonionic surfactants are conventionally produced by condensing ethylene oxide with a hydrocarbon having a reactive hydrogen atom, e.g., a hydroxyl, carboxyl, or amido group, in the presence of an acidic or basic catalyst. Nonionic surfactants have the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms, but can also be formed by the condensation of propylene oxide with a lower molecular weight compound. n usually varies from about 2 to about 24.

The hydrophobic moiety of the nonionic compound is preferably a primary or secondary, straight or branched, aliphatic alcohol having from about 8 to about 24, preferably from about 12 to about 20 carbon atoms. A more complete disclosure of suitable nonionic surfactants can be found in U.S. Pat. No. 4,111,855 said patent being incorporated herein by reference. Mixtures of nonionic surfactants can be desirable.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulfonates and sulfates disclosed in U.S. Pat. Nos. 3,925,262, Laughlin et al., issued Dec. 9, 1975 and 3,929,678, Laughlin et al., issued Dec. 30, 1975, said patents being incorporated herein by reference.

Semi- olar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Preferred in the compositions of this invention is a binary active system consisting essentially of: an anionic synthetic surface-active salt selected from the group of sulfonates and sulfates and an ethoxylated nonionic surface-active agent, whereby the weight ratio of the anionic surface-active salt to the nonionic ethoxylate is generally in the range from 4:1 to 1:4 and more preferably in the range from 5:2 to 3:4.

Suitable anionic synthetic surface-active salts are selected from the group of sulfonates and sulfates. The like nonionic detergents are eminently well-known in the detergent arts and have found wide-spread application in commercial detergents. Preferred anionic synthetic water-soluble sulfonates or sulfate salts have in their molecular structure an alkyl radical containing from about 8 to about 22 carbon atoms. Examples of such preferred anionic surfactant salts are the reaction products obtained by sulfating $C_8$–$C_{18}$ fatty alcohols derived from tallow and coconut oil; alkylbenzene sulfonates wherein the alkyl group contains from about 9 to 15 carbon atoms; sodium alkylglyceryl ether sulfonates; ether sulfates of fatty alcohols derived from tallow and coconut oils; coconut fatty acid monoglyceride sulfates and sulfonates; and water-soluble salts of paraffin sulfonates having from about 8 to 22 carbon atoms in the alkyl chain. Sulfonates olefin surfactants as more fully described in e.g. U.S. Patent No. 3,332,880, incorporated herein by reference, can also be used. The neutralizing cation for the anionic synthetic sulfonates and/or sulfates is represented by conventional cations which are widely used in detergent technology such as sodium and potassium.

A particularly preferred anionic synthetic surfactant component herein is represented by the water-soluble salts of an alkylbenzene sulfonic acid, preferably sodium alkylbenzene sulfonates having from about 10 to 13 carbon atoms in the alkyl group.

A preferred class of nonionic ethoxylates is represented by the condensation product of a fatty alcohol having from 12 to 15 carbon atoms and from about 4 to 10 moles of ethylene oxide per mole of fatty alcohol. Suitable species of this class of ethoxylates include: the condensation product of $C_{12}$–$C_{15}$ oxo-alcohols and 7 moles of ethylene oxide per mole of alcohol; the condensation product of narrow cut $C_{14}$–$C_{15}$ oxo-alcohols and 7 or 9 moles of ethylene oxide per mole of fatty (oxo) alcohol; the condensation product of a narrow cut $C_{12}$–$C_{13}$ fatty (oxo) alcohol and 6,5 moles of ethylene oxide per mole of fatty alcohol; and the condensation products of a $C_{10}$–$C_{14}$ coconut fatty alcohol with a degree of ethoxylation (moles EO/mole fatty alcohol) in the range from 5 to 8. The fatty oxo alcohols while mainly linear can have, depending upon the processing conditions and raw material olefins, a certain degree of branching, particularly short chain such as methyl branching. A degree of branching in the range from 15% to 50% (weight %) is frequently found in commercial oxo-alcohols.

Preferred nonionic ethoxylated components can also be represented by a mixture of 2 separately ethoxylated nonionic surfactants having a different degree of ethoxylation. For example, the noionic ethoxylate surfactant containing from 3 to 7 moles of ethylene oxide per mole of hydrophobic moiety and a second ethoxylated species having from 8 to 14 moles of ethylene oxide per mole of hydrophobic moiety. A prreferred nonionic ethoxylated mixture contains a lower ethoxylate which is the condensation product of a $C_{12}$–$C_{15}$ oxo-alcohol, with up to 50% (wt) branching, and from about 3 to 7 moles of ethylene oxide per mole of fatty oxo-alcohol, and a higher ethoxylate which is the condensation product of a $C_{16}$–$C_{19}$ oxo-alcohol with more than 5% (wt) branching and from about 8 to 14 moles of ethylene oxide per mole of branched oxo-alcohol.

The hydrogen peroxide, in the context of this invention interchangeably termed oxygen-bleach, is normally used in a level from 1% to 20%, preferably from 3% to 10% and more preferably from 5% to 8%. The hydrogen peroxide component is used as an oxidizing agent. It is well-known for that functionality and has found extensive application in textile treatment technology. The oxygen bleach (raw material) can be used as a concentrated aqueous solution of hydrogen peroxide containing frequently from 30% to 85% of hydrogen peroxide. Most preferred for reasons of convenience are aqueous concentrates containing from 30 to 35% (by weight) of $H_2O_2$. The oxygen bleach ingredient can also be incorporated via its molecular addition compound. For example, crystalline peroxyhydrates formed from oxyacid salts, metal peroxides, nitrogen compounds, zirconyl acetate and 1;4-diazabicyclo (2,2,2)-octane can be used. Preferred, because of commercial availability, are the peroxyhydrates formed from sodium carbonate and urea. While there seem to be diverging opinions as to the peroxyhydrate structure of sodium perborate, this material qualifies as an oxygen bleach in the context of this invention.

The essential fatty acid component herein can be saturated or unsaturated species having from 8 to 24, preferably from 10–16 carbon atoms in the alkyl chain and are present in a level from 5% to 30%, preferably from 8% to 16%. The saturated fatty acids shall represent at least 50% of the mixture of saturated and unsaturated fatty acids. The preferred saturated fatty acids have from 10 to 16, more preferable 12 or 14 carbon atoms in the alkyl chain. The most preferred fatty acids are lauric and myristic fatty acids in a mixture of 5:1 to 1:1. Preferred unsaturated fatty acids are those having, for example, 16 or 18 carbon atoms in the alkyl chain. Known examples of the unsaturated fatty acids are oleic fatty acid and palmitoleic fatty acid.

The weight ratio of surface-active-agent to fatty acid is equal to or greater than 1.

The water-soluble calcium salt shall be present in a level to provide, at lease, $5.10^{-3}$ mole calcium per liter of the liquid detergent. The term "water-soluble" means that suitable calcium salts shall have a solubility, in water at 20° C., of at least 1%. Preferred calcium salts for use herein are: calcium acetate; calcium chloride; calcium propionate; calcium ascorbate; and calcium lactate.

The liquid detergent compositions herein shall be substantially free of polyphosphates such as the alkali salts of: pyrophosphates; tripolyphosphates; hexametaphosphates; and Graham's salt. It is believed that the presence of substantial levels of polyphosphate builders can adversely affect the effectiveness of the oxygen-bleach stabilizing system, possibly by causing a shift in the fatty acid-calcium stability constant.

The compositions herein have a pH, measured "as is" at 20° C. below 9, preferably in the range from 7 to 8.5.

An optional, but frequently desirable, ingredient in the compositions herein is a water-soluble cationic surfactant having the general formula $R^2{}_mR_x{}^3Y_LZ$ wherein $R^2$ is an organic group containing a straight or branched alkyl or alkenyl group optionally substituted with up to three phenyl or hydroxy groups and optionally interrupted by up to four structures selected from the group consisting of

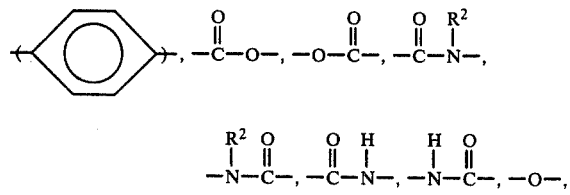

and mixtures thereof, each $R^2$ containing from about 8 to 22 carbon atoms, and which may additionally contain up to about 12 ethylene oxide groups, m is a number from 1 to 3, each $R^3$ is an alkyl or hydroxyalkyl group containing from 1 to 4 carbon atoms or a benzyl group with no more than one $R^3$ is a molecule being benzyl, x is a number from 0 to 11, the remainder of any carbon atom positions being filled by hydrogens, Y is selected from the group consisting of:

(1) $-\overset{|}{\underset{|}{N^+}}-$, (2) $-\overset{|}{\underset{|}{P^+}}-$, (3) $-\overset{|}{S^+}-$, (4) $-\overset{(C_2H_4O)_mH}{\underset{(C_2H_4O)_pH}{N^+}}-$, wherein m and p are independently selected from 1 to 12, (5) $-\overset{C_{1-6}\text{ alkyl}}{\underset{(C_2H_4O)_pH}{N^+}}-$, wherein p is from 1 to 12, and (6) mixtures thereof.

The term "water-soluble" in relation to the cationic surfactant expresses that the cationic component shall have a solubility of at least 0.2 gr/100 ml water at 20° C.

The cationic ingredient represents desirably from 0.5% to 5% of the liquid detergent composition.

A more complete disclosure can be found in U.S. Pat. No. 4,228,044, by Cushman M. Cambre for Laundry Detergent Composition Having Enhanced Particulate Soil Removal and Antiredeposition Performance, said patent being incorporated herein by reference.

Preferred cationic surfactant species for use herein are: N-cocyltrimethylammonium chloride; N-lauryldimethylbenzyl ammonium methosulfate; N-myristyldi(hydroxyethyl)methylammonium bromide.

In addition to the essential and optional components described hereinbefore, the compositions of this invention frequently contain one or more optional ingredients which are used for their known functionality in conventional levels.

While the compositions herein contain water as a matrix component, it is frequently desirable to use a phase regulant. The latter component together with the water constitutes the solvent matrix for the liquid composition. Suitable phase regulants are well-known in liquid detergent technology and, for example, can be represented by lower aliphatic alcohols having from 2 to 6 carbon atoms and from 1 to 3 hydroxyl groups, ethers of diethylene glycol and lower aliphatic monoalcohols having from 1 to 4 carbon atoms. Specific examples of phase regulants are: ethanol, n-propanol; isopropanol; butanol; 1,2-propanediol; 1,3-propanediol; n-hexanol; 2-methyl-2.4-pentanediol; monomethyl-, -ethyl-, -propyl, and mono-butyl ethers and di-ethylene glycol. Additional phase regulants having a relatively high boiling point and low vapor pressure can also be used provided they do not react with the other ingredients of the compositions.

Known detergent hydrotropes are a further class of phase regulants suitable for use herein. Examples of these hydrotropes include salts of alkylarylsulfonates having up to 3 carbon atoms in the alkylgroup, e.g., sodium, potassium, and ammonium salts of xylene-, toluene-, ethylbenzene-, and cumene sulfonic acids. The phase regulant is frequently used in an amount from about 5% to about 20%; the sum of phase regulant and water is normally in the range from 65% to 35%.

The compositions herein can contain a series of further optional ingredients which are mostly used in additive levels, usually below about 5%. Examples of the like additives include: polyacids, enzymes and enzymatic stabilizing agents, suds regulants, opacifiers, agents to improve the machine compatibility in relation to enamel-coated surfaces, bactericides, dyes, perfumes, brighteners and the like.

A preferred additive is represented by a polyacid or mixture of polyacids in an amount below about 5%. P-containing polyacids are frequently used in levels below 2%. Suitable polyacids can include: citric, cyclohexane-1,1-dicarboxylic, cyclopropane-1,1-dicarboxylic, dimethylmalic, glutaric, o-hydroxybenzoic, m-hydroxybenzoic, p-hydroxybenzoic, itaconic, methylsuccinic, and nitrilotriacetic acid. Preferred poly-acid species for use herein can be represented by citric acid and organo-phosphoric acids and mixtures thereof. Particularly preferred alkylene-polyamino-polyalkylene phosphonic acids are ethylenediamine tetramethylenephosphonic acid, hexamethylenediamine tetramethylenephosphonic acid, diethylenetriamine pentamethylenephosphonic acid, and aminotrimethylenephosphonic acid or the salts thereof. These organo-phosphonic acids/salts are preferably used in an amount from 0.1%–0.8%.

The beneficial utilization of the claimed compositions under various usage conditions can require the utilization of a suds regulant. While generally all detergent suds regulants can be utilized preferred for use herein are alkylated polysiloxanes such as dimethylpolysiloxane also frequently termed silicones. The silicones are frequently used in a level not exceeding 0.5%, most preferably between 0.01% and 0.2%.

Detergent enzymes generally aid in the removal of specific stains. Suitable enxymes can be represented by proteases, amylases, lipases, glucose oxidases or mixtures thereof. Proteases and amylases can be particularly useful in the claimed compositions. Proteases are frequently employed in a level from 0.01% to 1%, whereas amylases can beneficially be added in a level from 0.01% to 0.5%. From 0.05% to 1% of a mixture of proteases and amylases was found to be beneficial. The enzymatic, particularly the proteolytic, activity and stability can be greatly enhanced with the aid of additive levels, usually 0.2% to 3% of a carboxylic acid having from one to three carbon atoms. The most preferred enzyme stabilization carboxylic ingredient is formic acid.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by MONSANTO CHEMICAL CORPORATION. The opacifiers are frequently used in an amount from 0.3% to 1.5%.

The liquid detergent compositions of this invention further can comprise an agent to improve the washing machine compatibility, particularly in relation to enamel-coated surfaces. γ-aminosilanes used in a level in the range from 0.001 to 1% are especially useful in this respect. Suitable aminosilanes are described in Great-Britain patent application 81-29069 of Sept. 25, 1981, this patent application being incorporated herein by reference.

The liquid compositions herein can contain a further optional ingredient from 0.1 to 1% of a polyaminopolycarboxylate such as ethylene diaminetetraacetic acid or diethylenetriaminopentaacetic acid; or the water-soluble alkali or ammonium salts thereof.

It can further be desirable to add from 0.1% to 5% of known antiredeposition and/or compatibilizing agents. Examples of the like additives include: sodium carboxymethylcellulose; hydroxy-$C_{1-6}$-alkyl-cellulose; polycarboxylic homo- or copolymeric ingredients, such as: polymaleic acid; a copolymer of maleic anhydride and methylvinylether in a molar ratio of 2:1 to 1:2; and a copolymer of an ethylenically unsaturated monocarboxylic acid monomer, having not more than 5, preferably 3 or 4 carbon atoms, for example (meth)-acrylic acid, and an ethylenically unsaturated dicarboxylic acid monomer having not more than 6, preferably 4 carbon atoms, whereby the molar ratio of the monomers is in the range from 1:4 to 4:1, said copolymer being described in more detail in GB patent application 81-16607 of May 30, 1981, this application being incorporated herein by reference.

The following examples illustrate the invention and facilitate its understanding.

Liquid detergent compositions were prepared by mixing the listed ingredients in the stated proportions:

| | Composition (%) | | | |
|---|---|---|---|---|
| Ingredients | A | B | C | I |
| Linear dodecylbenzene sulfonic acid | 14 | 8 | 14 | 14 |
| Condensation product of one mole of C13–C15 OXO alcohol and 7 moles of ethylene oxide | 10 | 15 | 20 | 15 |
| Lauric acid | — | 5 | 2 | 10 |
| Oleic acid | 2 | 2 | 2 | 5 |
| Sodium Hydroxide to adjust pH to | 7.6 | 7.0 | 7.0 | 7.6 |
| Ethanol | 10 | 7 | 10 | 9 |
| 1.2 Propanediol | — | 5 | 3 | 3 |
| Calcium[a] | 5 | — | — | 10 |
| Diethylenetriamine pentamethylene-phosphonic acid | 0.3 | 0.3 | — | 0.5 |
| Ethylene diamine tetra acetic acid | — | — | 0.5 | 0.6 |
| $H_2O_2$ (on 100% basis) | 6 | 6 | 6 | 6 |
| Silicone suds regulant; brightener; perfume; opacifier; dye; and water. | Balance to 100 | | | |

[a]added as calcium acetate and expressed as millimoles of calcium ions per liter of composition.

The stability of the $H_2O$ in the listed compositions was determined under accelerated conditions after 2 weeks at 50° C. and under trade conditions—4 weeks at 20° C.

Compositions A, B and C are representative of the prior art. Composition I is representative of the invention herein.

The testing data are summarized below:

| | Composition | | | |
|---|---|---|---|---|
| | A | B | C | I |
| Available oxygen left in % after 2 weeks at 50° C. | 48.2 | 40.2 | 15.0 | 95.0 |
| Available oxygen left in % after 4 weeks at 20° C. | 94.1 | 89.3 | 67.3 | 99.5 |

These results confirm the remarkable stability benefits provided by composition I in accordance with this patent vs. formulation-wise related art compositions A, B and C.

Laundry performance benefits are obtained from the use of composition I vs. the prior art formulae, mainly on bleachable stains and builder sensitive stains. The benefits are achieved throughout the full range of wash temperatures but are particularly outstanding at a wash-water temperature comprised in the range from 60° C. up to the boil.

Further compositions of this invention were prepared by mixing the liquid components in the indicated proportions:

| | Composition (%) | | | |
|---|---|---|---|---|
| Ingredients | D | II | III | IV |
| Linear dodecylbenzene sulfonic acid | 14 | 14 | 14 | 14 |
| Condensation product of one mole of C13–C15 OXO alcohol with 25% of branching and 7 moles of ethylene oxide | 15 | 15 | 15 | 15 |
| Lauric acid | 2 | 10 | 10 | 10 |
| Oleic acid | — | 5 | 5 | 5 |
| NaOH to adjust pH to | 7.5 | 7.5 | 7.5 | 7.5 |
| Ethanol | 12 | 12 | 12 | 12 |
| Calcium[a] | — | 10 | 5 | 10 |
| Diethylenetriamine pentamethylene-phosphonic acid | — | 0.5 | 0.5 | 0.5 |
| Diethylenetriamine pentaacetic acid | 0.5 | 0.6 | 0.6 | — |
| Ethylene diamine tetraacetic acid | — | — | — | 0.6 |
| $H_2O_2$ (on 100% basis) | 6 | 6 | 6 | 6 |
| Silicone suds regulant; brightener; perfume; dyes; opacifier and water | Balance to 100 | | | |

[a]Added as calcium acetate and expressed as millimoles of calcium ions per liter of composition Composition D is a reference composition, whereas formulae II, III, and IV are executions of the invention.

The $H_2O_2$ stability (expressed in % residual available oxygen) was determined under accelerated conditions after 2 weeks at 50° C.

| | Composition | | | |
|---|---|---|---|---|
| | D | II | III | IV |
| Residual available oxygen (%) | 12 | 90 | 60 | 88 |

These results demonstrate the superiority of the claimed technology vs. the prior art technology.

We claim:

1. An aqueous liquid detergent containing, (a) from 10% to 60% by weight of an anionic, non-ionic, or zwitterionic surface-active agent or mixtures thereof; and (b) from 1% to 20% by weight of hydrogen peroxide;

(c) from 5% to 30% by weight of a fatty acid having from 8 to 24 carbon atoms, whereby the weight ratio of (a) to (c) is equal to or greater than 1; and (d) a water-soluble calcium salt to provide at least $5.10^{-3}$ mole calcium per liter of the liquid detergent, said detergent being substantially free of polyphosphates; and having a pH, as is at 20° C., below 9.

2. The liquid composition in accordance with claim 1, wherein at least 50% by weight of the fatty acid is a saturated fatty acid having from 10 to 16 carbon atoms.

3. The liquid composition in accordance with claim 1, wherein the calcium salt is selected from the group consisting of: calcium chloride; calcium propionate; calcium ascorbate, calcium lactate, and calcium acetate.

4. The liquid composition in according with claim 2, wherein the saturated fatty acids are lauric and myristic acids in a weight ratio of 5:1 to 1:1.

5. The liquid composition in accordance with claim 1, which, in addition, contains from 0.5% to 5% by weight of a water-soluble cationic surface-active agent.

6. The liquid composition in accordance with claim 1, which, in addition, contains from 0.1% to 2% by weight of an alkylene-amino phosphonic acid or its water-soluble alkali or ammonium salts, said phosphonic acid being selected from the group of:

ethylenediaminetetramethylenephosphonic acid;

hexamethylenediaminetetramethylenephosphonic acid;

diethylenetriaminepentamethylenephosphonic acid;

and, aminotrimethylenephosphonic acid.

7. The liquid composition in accordance with claim 1, which, in addition, comprises from 5% to 20% by weight of a phase regulant selected from lower alcohols having from 2 to 6 carbon atoms and from 1 to 3 hydroxyl groups.

8. The liquid composition in accordance with claim 1, which, in addition, contains from 0.05% to 1% by weight of a mixture of proteases and amylases.

9. The liquid composition in accordance with claim 5, wherein the cationic surfactant is selected from N-cocoyltrimethylammonium chloride; N-lauryldimethylbenzyl ammonium methosulfate; N-myristyl-di(hydroxyethyl)-methylammonium bromide.

10. The liquid composition in accordance with claim 1, which, in addition, contains from 0.1% to 1% by weight of ethylenediaminetetraacetic acid or diethylenetriaminepentaacetic acid or the water-soluble alkali or ammonium salts thereof.

* * * * *